US009958153B2

(12) United States Patent
Suemitsu et al.

(10) Patent No.: US 9,958,153 B2
(45) Date of Patent: May 1, 2018

(54) UPSIDE-DOWN TYPE LOW NOX BOILER

(75) Inventors: Nobuo Suemitsu, Yachiyo (JP); Sadayuki Muto, Saitama (JP); Shinichi Toda, Tokyo (JP); Minoru Igarashi, Shiroi (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 1769 days.

(21) Appl. No.: 13/124,989

(22) PCT Filed: Dec. 8, 2009

(86) PCT No.: PCT/JP2009/070546
§ 371 (c)(1),
(2), (4) Date: Apr. 19, 2011

(87) PCT Pub. No.: WO2010/067798
PCT Pub. Date: Jun. 17, 2010

(65) Prior Publication Data

US 2011/0197829 A1 Aug. 18, 2011

(30) Foreign Application Priority Data

Dec. 12, 2008 (JP) ..... 2008-316721

(51) Int. Cl.
*F22B 37/10* (2006.01)
*F23C 6/04* (2006.01)
(Continued)

(52) U.S. Cl.
CPC ..... *F23C 6/04* (2013.01); *F23C 5/08* (2013.01); *F23C 6/045* (2013.01); *F23G 5/165* (2013.01); *F23C 2201/101* (2013.01)

(58) Field of Classification Search
USPC ..... 122/235.23, 511, 235.12, 235.11
See application file for complete search history.

(56) References Cited

U.S. PATENT DOCUMENTS 2,864,344 A * 12/1958 Artsay ..... 122/494

FOREIGN PATENT DOCUMENTS

JP 05272704 A * 10/1993 ..... F22B 31/00
JP 06050507 A * 2/1994 ..... F23C 11/00
(Continued)

OTHER PUBLICATIONS

Feb. 25, 2013 Office Action issued in Korean Patent Application No. 10-2011-7010716 (with English translation).
(Continued)

*Primary Examiner* — Steven B McAllister
*Assistant Examiner* — Ko-Wei Lin
(74) *Attorney, Agent, or Firm* — Oliff PLC

(57) ABSTRACT

In a low NOx boiler of the present invention, a high-temperature reductive combustion zone is provided to an upper portion of a rectangular combustion chamber, and a second-step combustion zone is provided to a middle stage of the combustion chamber. A wall provided below the second-step combustion zone is tapered to narrow the combustion chamber, with a taper angle of approximately 35° or so, relative to a vertical line. An ash discharge port is provided to a furnace bottom portion, and a gas outlet port communicated with a rear pass is provided to a lower side face of the second-step combustion zone. This rear pass is connected with a further post-treatment step, via a superheater tube and an economizer.

11 Claims, 7 Drawing Sheets

(51) Int. Cl.
*F23C 5/08* (2006.01)
*F23G 5/16* (2006.01)

(56) References Cited

FOREIGN PATENT DOCUMENTS

| | | | | |
|---|---|---|---|---|
| JP | A-6-50507 | | 2/1994 | |
| JP | A-6-58507 | | 3/1994 | |
| JP | 06241407 | A * | 8/1994 | ..... F22B 37/24 |
| JP | A-6-241407 | | 8/1994 | |
| JP | A-9-25730 | | 9/1997 | |
| JP | A-9-257230 | | 9/1997 | |
| JP | B2-2667607 | | 10/1997 | |
| JP | A-2001-227702 | | 8/2001 | |
| JP | A-2003-074802 | | 3/2003 | |
| KR | 20-2010-0010024 | | 10/2010 | |
| KR | 20-2011-0000572 | | 1/2011 | |

OTHER PUBLICATIONS

International Search Report dated Feb. 16, 2010 issued in International Patent Application No. PCT/JP2009/070546 (with translation).
International Preliminary Report on Patentability issued in International Patent Application No. PCT/JP2009/070546 dated Jul. 5, 2011.
Sep. 12, 2013 Korean Notice of Allowance issued in Korean Patent Application No. 10-2011-7010716.

* cited by examiner

UPSIDE-DOWN TYPE LOW NOX BOILER

BACKGROUND OF THE INVENTION

Field of the Invention

The present invention relates to a thermal boiler configured for obtaining energy by combusting fossil fuel or the like, and particularly relates to a lowz NOx boiler, which can reduce the discharge amount of NOx, without preparing any special or additional de-nitration apparatus.

Background Art

In general, the term "NOx" (which is discharged by the combustion of the fossil fuels or the like) means a gaseous matter containing NO and $NO_2$. For the environmental preservation, it is necessary to reduce the discharge of such NOx gas strictly. Meanwhile, for slowing down the drying up of the oil fuel and saving the fuel cost, a low-quality fuel, containing a relatively large amount of nitrogen-containing materials, residual carbon and/or ash-forming materials, e.g., asphalt, petroleum coke, carbonized sewage sludge or the like, has been used occasionally as a boiler fuel. In the case of using such a low-quality fuel, reducing an unwanted environmental load due to exhaust combustion gas, e.g. low NOx combustion, low-soot-and-dust combustion or the like, as well as stabilized continuous operation of the boiler, e.g. positively controlling dust trouble due to combustion ash, are widely requested. In particular, in the case of using the low-quality fuel containing a relatively large amount of nitrogen and residual carbon, reducing the discharge amount of NOx, soot and dust is requested more strictly than ever before.

As one approach for reducing the NOx discharge amount of the boiler, a two-step combustion method, a combustion-gas recirculation method or the like, each utilizing the phenomenon that the NOx generation amount strongly depends on $O_2$ partial pressure as well as on the combustion temperature, in a combustion region, has been reported. The two-step combustion method includes a first step of combusting the fuel, at a relatively high temperature, while the combustion air supplied to a burner zone is kept in a reduced condition lower than a theoretical combustion air ratio, so as to control the NOx generation amount, and a second step of further and completely combusting the fuel still remaining uncombusted, at a relatively low temperature, under an oxidative atmosphere, with excessive air separately supplied, thus substantially reducing the NOx discharge amount. In addition, the combustion-gas recirculation method includes a step of mixing or incorporating a part of the combustion gas, in a recirculation manner, into the combustion air, and then introducing high-temperature air, with lowered $O_2$ partial pressure, into the resultant mixed gas, so as to adequately lower the flame temperature, under a slow combustion condition, thereby to effectively reduce the NOx discharge amount.

As the conventional art employing the two-step combustion technology, one structure of the low NOx boiler which was created by the inventor of this application and was described in Patent Document 1 is known. This low NOx boiler, as shown in FIG. 10, is constructed as below. A refractory material 30 is attached to an inner circumferential wall of the boiler. A high-temperature reductive combustion zone 32 is provided to a bottom portion of a combustion chamber 33, and has burners 31 mounted to a side wall thereof. The second-step combustion zone is provided above the high-temperature reductive combustion zone 32, via a narrowed portion 34, and has an inner circumferential wall formed into a water wall structure. Further, this second-step combustion zone includes second-step combustion air nozzles 35 respectively attached to a side wall thereof. Additionally, a superheater 37 is provided to an upper portion of the combustion chamber 33.

In the high-temperature reductive combustion zone 32, the fuel is combusted, at an excessive fuel concentration, with the temperature kept relatively high (e.g., approximately 1500° C. on average). Then, the combustion air is newly supplied, from the respective second-step combustion air nozzles 35, to the resultant combustion gas flowed upward into the second-step combustion zone 36 through the narrowed portion 34. In this way, the combustion of the fuel can be completed, under the oxidative atmosphere, at the relatively low temperature.

As illustrated by one experimental result shown in FIG. 3, the total amount of nitrogen-containing (or, N-containing) products, such as NO and the like, generated by the combustion, is decreased as the temperature is elevated, under a reductive atmosphere of the air ratio less than one (i.e., the air ratio<1), while being decreased as the temperature is lowered in the oxidative atmosphere of the air ratio greater than one (i.e., the air ratio>1). Namely, the two-step combustion technology described in the above Patent Document 1 utilizes this phenomenon, in order to effectively reduce the NOx generation during the combustion of the fuel containing a considerably large amount of nitrogen. More specifically, in the low NOx boiler described in the Patent Document 1, the fuel is first combusted, at the relatively high temperature, under the reductive atmosphere, in the high-temperature reductive combustion zone 32, and then the air is supplied, at the relatively low temperature, to the partly combusted gas flowed into the second-step combustion zone 36. As such, the fuel remaining uncombusted can be further combusted under the low-temperature oxidative atmosphere. Thus, the fuel combustion can be substantially completed, thereby reducing the NOx discharge amount in each zone.

In fact, such configuration of the low NOx boiler is now applied to an actual machine and serves to effectively combust or burn bunker-C, asphalt or the like. In this case, when the low-quality fuel, such as the petroleum coke, carbonized sewage sludge or the like, is used as the boiler fuel, the effect of reducing the NOx discharge amount can be achieved enough. However, since such a low-quality fuel contains a considerably large amount of ash-forming materials, produced by vanadium and the like metal, the so large amount of ash is likely to be accumulated on a furnace bottom portion, presenting a new concern.

For instance, when the low NOx boiler as disclosed in the above Patent Document 1 is operated continuously for about several to six months, a considerably large amount of ash generated by the combustion of the low-quality fuel is accumulated in the furnace. Therefore, it is necessary to periodically stop the operation of the boiler and remove such accumulated ash therefrom. However, it is quite difficult to remove, safely and securely, the ash from the furnace bottom portion, because such ash accumulated thereon is still melted at a considerably high temperature. Besides, the high-temperature reductive combustion zone surrounding the furnace bottom portion is filled with the combustion gas that is still partly combusted at the high temperature and contains poisonous gases and/or components, such as carbon monoxide, hydrogen sulfide and the like.

To effectively remove such ash, provision of a proper ash discharge port to the furnace bottom portion can be considered. However, as described above, the atmosphere in the high-temperature reductive combustion zone around the furnace bottom portion is filled with the poisonous gases heated at the high temperature. Therefore, in view of a risk of inadvertent and/or accidental gas leakage, it is rather problematic to provide the ash discharge port to such a furnace bottom portion. Further, if the ash discharge port is provided to the furnace bottom portion, the outside air may tend to enter the furnace bottom portion through the ash discharge port. This may cause negative impact on the high-temperature reductive combustion atmosphere, thus seriously deteriorating the ability for adequately performing the low NOx combustion and/or low-soot-and-dust combustion.

While the ash is melted during the fuel combustion, because of the considerably high-temperature atmosphere around the furnace bottom portion, this ash is solidified after the furnace is cooled. Therefore, for discharging such ash from the furnace bottom portion after the furnace is cooled, it is necessary to crush the ash by using a rock drill or the like. However, this operation requires frequent stop and start of the furnace as well as an unduly high cost for the maintenance.

Patent Document 1: JP2667607B

SUMMARY OF THE INVENTION

Therefore, it is an object of the present invention to provide a new low NOx boiler, which can significantly reduce the NOx discharge amount, while enabling the ash to be successfully discharged without any stop of the boiler. In this case, the low NOx boiler of this invention can be operated continuously, without any stop, even through using the low-quality fuel containing a considerably large amount of nitrogen-containing materials and ash-forming materials.

In order to achieve the above object, the upside-down type low NOx boiler of this invention is provided to obtain thermal energy by combusting liquid, gaseous or powdered carbon fuel containing the nitrogen-containing materials and ash-forming materials, and comprises a vertical-type integrated combustion chamber. The vertical-type integrated combustion chamber includes; a high-temperature reductive combustion zone provided to an upper portion of the combustion chamber and surrounded by a refractory material and having a burner; a second-step combustion zone provided below the high-temperature reductive combustion zone and having a second-step combustion air nozzle; a combustion gas outlet port provided below the second-step combustion zone; and an ash discharge mechanism provided to the furnace bottom portion of the combustion chamber. With this configuration, burner combusts the carbon fuel charged into the high-temperature reductive combustion zone, under a high-temperature reductive atmosphere, so as to produce a combustion gas, and then the second-step combustion air nozzle supplies a second-step combustion air having a temperature lower than a temperature of the combustion gas to the combustion gas flowed downward toward the second-step combustion zone located below the high-temperature reductive combustion zone, so as to complete the combustion of the carbon fuel under a low-temperature oxidative atmosphere. In this case, the combustion gas is flowed out from the combustion gas outlet port located below the second-step combustion zone, and an ash that is accumulated on the furnace bottom portion of the combustion chamber is discharged in solid state, during the operation of the furnace, by using the ash discharge mechanism.

It is preferred that a narrowed portion for reducing the horizontal cross section of the combustion chamber by 20%-50%, is provided between the high-temperature reductive combustion zone and the second-step combustion zone. Preferably, the furnace bottom portion of the combustion chamber is tapered, with a taper angle less than or equal to 45°, more preferably 35° or so, relative to a vertical line to the bottom furnace of the combustion chamber. With this configuration, the ash discharge mechanism provided to a lower end of the tapered portion (i.e., the furnace bottom portion) can efficiently discharge the ash from the furnace, with a simple structure.

Further, the burners may be arranged along two opposite side faces of the high-temperature reductive combustion zone, respectively, horizontally in parallel with one another, with the flame axes of the burners respectively oriented not to cross one another.

As described above, the upside-down type low NOx boiler of the present invention can first combust the fuel under the high-temperature reductive atmosphere in the high-temperature reductive combustion zone, and then further and completely combust the combustion gas containing the fuel remaining uncombusted, under the low-temperature oxidative combustion atmosphere in the second-step combustion zone, thereby effectively suppressing the NOx generation. In particular, this boiler is configured to allow the combustion gas to be flowed downward, from the upper portion to the bottom portion of the combustion chamber. Further, appropriate buoyancy can be exerted, on the combustion gas, upward in the direction reverse to the gas flow. Therefore, the density of the combustion gas can be successfully increased. As such, as compared with the conventional low NOx boiler, the combustion efficiency can be substantially enhanced, and hence the temperature in the reductive combustion zone located at the upper portion of the combustion chamber can be further elevated. Thus, the temperature distribution in the combustion chamber can be further uniformed. In conclusion, it is possible to significantly enhancing the effect of the low NOx combustion and/or low-soot-and-dust combustion.

According to this invention, with the configuration including the high-temperature reductive combustion zone provided at the upper portion of the combustion chamber, and allowing the combustion gas having the relatively low temperature to be flowed out from the lower portion of the combustion chamber, the combustion ash can be securely accumulated on the furnace bottom portion, as well as the ash discharge mechanism can be safely provided to the furnace bottom portion. While the combustion ash is melted and liquefied in the high-temperature reductive combustion zone, it is solidified, once flowed downward together with the combustion gas into the second-step combustion zone and then cooled below the melting point thereof. Thus, such ash falls down onto the furnace bottom portion, and is accumulated thereon in a solid state.

Further, since the ash discharge mechanism is surrounded by the low-temperature oxidative atmosphere, the combustion can be adequately kept, without undergoing any influence, even though the bottom furnace is opened to the air by the ash mechanism. Accordingly, the ash can be discharged, safely and securely, during the operation of the furnace. This can enable such a long-period continuous operation of the furnace that has not been so far achieved by the conventional low NOx boiler, and can also substantially reduce the cost for the maintenance. Furthermore, with the configuration of this invention that can allow the use of the low-quality fuel containing a considerable amount of ash-forming materials, the fuel cost can also be substantially reduced.

DESCRIPTION OF EMBODIMENTS

Hereinafter, one embodiment of the present invention will be described with reference to the drawings.

Figure 1:
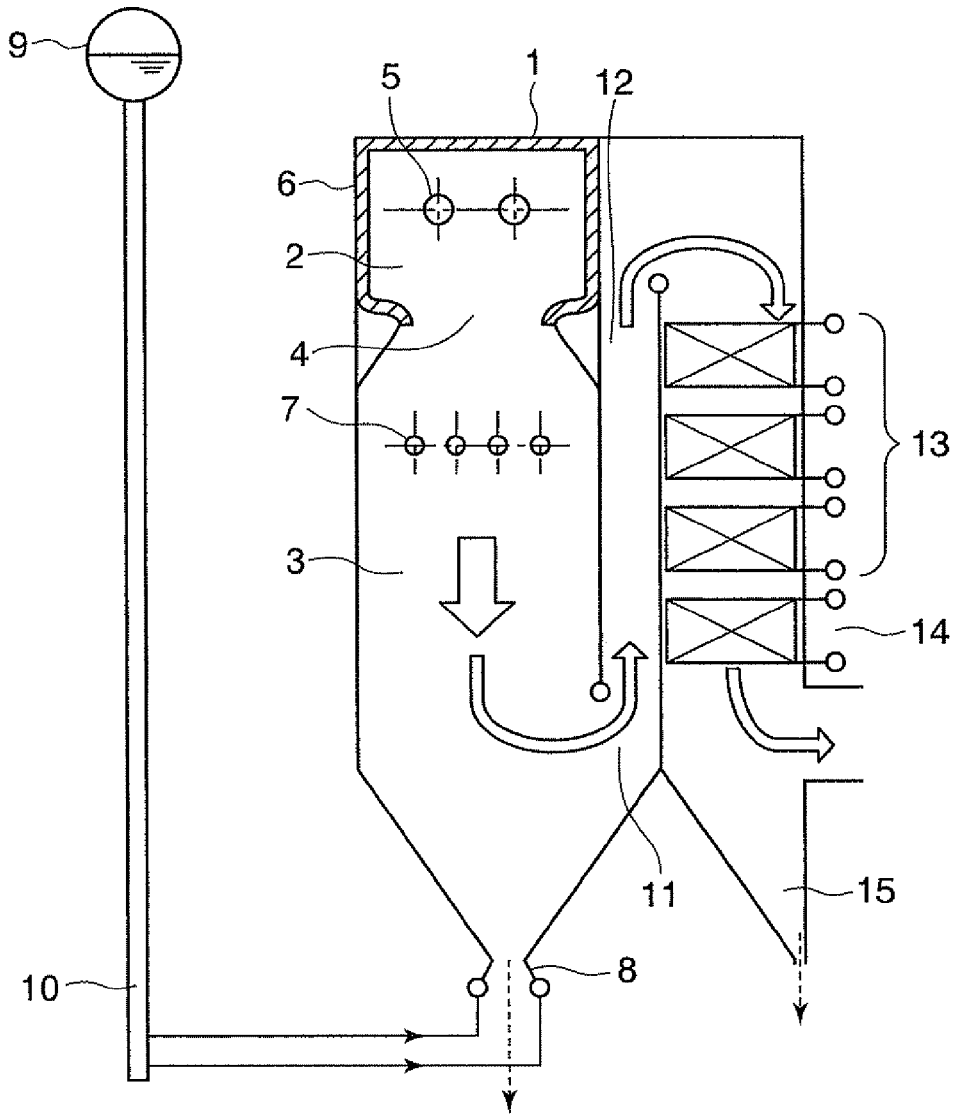
FIG. 1 is a functional diagram schematically showing the upside-down type low NOx boiler in one embodiment of the present invention.
Figure 2:
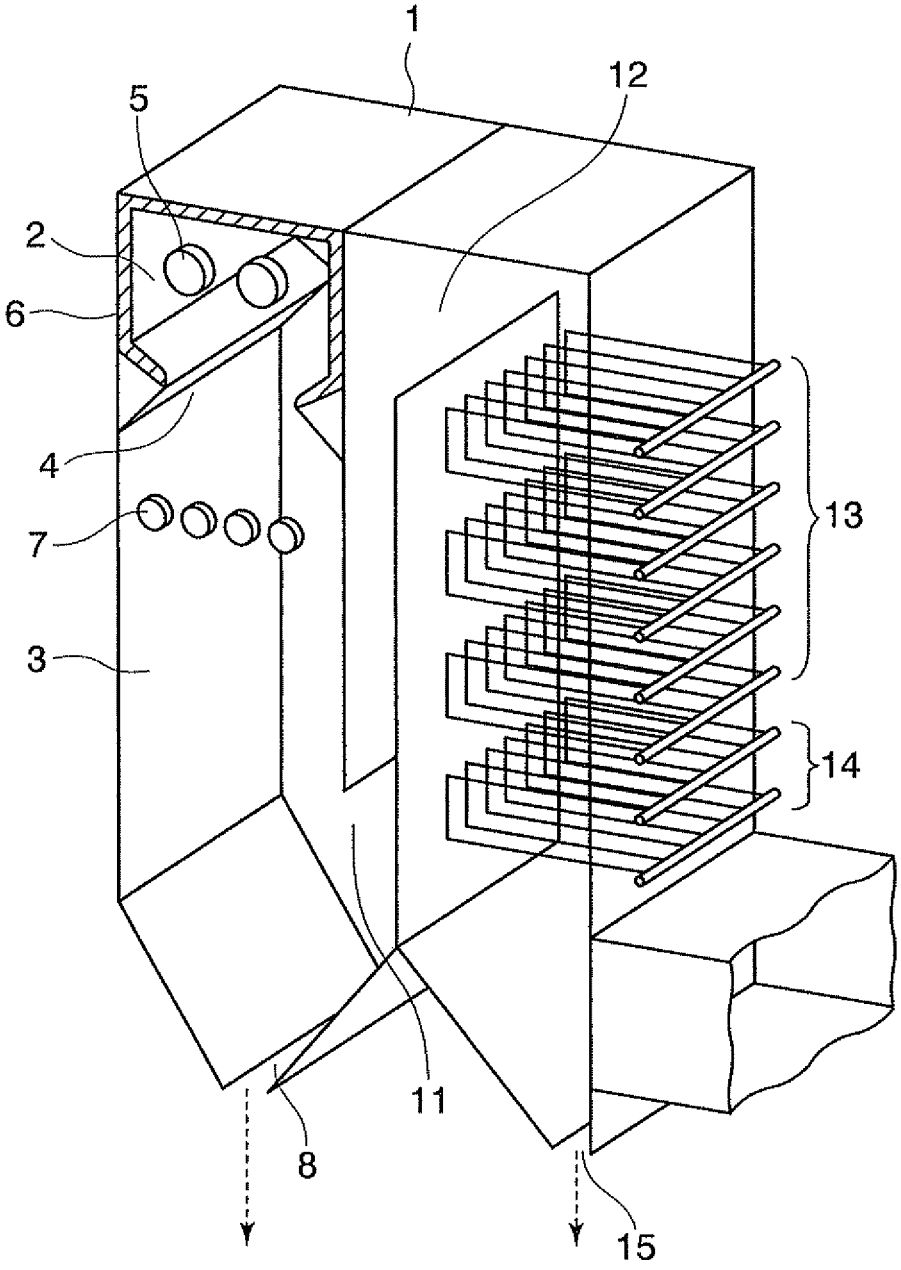
FIG. 2 is a perspective view schematically showing the upside-down type low NOx boiler in the embodiment of the present invention shown in FIG. 1.

As shown in FIGS. 1 and 2, the upside-down type low NOx boiler of this embodiment includes the high-temperature reductive combustion zone 2 provided to the upper portion of the vertical-type combustion chamber 1, and the second-step combustion zone 3 provided to a middle stage of the chamber 1. The high-temperature reductive combustion zone 2 and second-step combustion zone 3 are separated from each other by the narrowed portion 4. A suitable number of burners 5 are provided to side walls of the high-temperature reductive combustion zone 2. Each side wall and a top wall of the high-temperature reductive combustion zone 2 are covered with a proper refractory material 6 durable against the furnace temperature of approximately 1650° C. or higher.

The narrowed portion 4 has a flange-like projection projecting inward and extending along the whole inner circumference of the combustion chamber 1. This narrowed portion 4 is provided to reduce the cross section of the gas passage in the combustion chamber 1 by approximately 20% to 50%. The surface of the narrowed portion 4 facing the high-temperature reductive combustion zone 2 is covered with the refractory material, in the same manner as the high-temperature reductive combustion zone 2. The burners 5 are provided to opposite two side faces of the high-temperature reductive combustion zone 2 of the combustion chamber 1, while being respectively arranged horizontally in parallel with one another. These burners 5 are arranged in axially parallel with one another, with a suitable space, in order to prevent the axes of the burner flame from being directly opposite to one another.

Further, below the narrowed portion 4, a suitable number of second-step combustion air nozzles 7 are arranged and the second-step combustion zone 3 is formed. A lower portion of the second-step combustion zone 3, e.g. a wall of the combustion chamber is tapered, with the taper angle of approximately 35° relative to the vertical line. The ash discharge port 8 is provided to a lower end of the tapered furnace bottom portion. The optimum value of the taper angle varies with the critical contact angle between the material (or ash) accumulated on the second-step combustion zone 3 and the wall of the second-step combustion zone 3. However, if such an accumulated material is likely to be collapsed, even a relatively large angle, such as 45° or so, can be used as the taper angle. Each side wall, depicted as a boundary wall in the drawings, of the second-step combustion zone 3 has the water wall structure including water wall tubes provided therein for cooling the second-step combustion zone 3 and the like. More specifically, the water wall tubes are connected with a non-heated downcomer pipe 10 at a bottom portion of the combustion chamber 1, such that adequately high pressure boiler water can be securely supplied to the combustion chamber 1, via the non-heated downcomer pipe 10, from a steam drum 9 provided in a position higher than the combustion chamber 1.

The gas outlet port 11 is provided in a lower side wall of the second-step combustion zone 3, and is communicated with a rear pass 12. The rear pass 12 is configured to feed therethrough the combustion gas to a post-treatment step, after passing the combustion gas through a super-heater tube 13 and an economizer 14 respectively provided en route. Further, another ash discharge port 15 is provided to a bottom portion of a combined body of the super-heater tube 13 and economizer 14.

The upside-down type low NOx boiler of this embodiment is provided as the thermal boiler adapted for combusting a liquid, gaseous or powdered carbon fuel in order to obtain the thermal energy from the resultant combusted gas. More specifically, the upside-down type low NOx boiler of this embodiment is configured, such that the fuel can be supplied to a top portion of the combustion chamber 1 in order to first perform the combustion of the fuel under the reductive atmosphere, and then the combustion can be advanced downward from the top portion of the chamber 1 in order to further combust and complete the combustion under the oxidative atmosphere, and finally the resultant combustion gas can be taken out from the lower portion of the chamber 1.

In this procedure, the fuel and air are first introduced toward each burner 5 in order to start the combustion in the high-temperature reductive combustion zone 2. In the high-temperature reductive combustion zone 2, the introduction of the air is controlled to keep the air ratio in the reductive atmosphere lower than or equal to 1, for example, approximately 0.6 to 0.8. Under this reductive atmosphere, the fuel is combusted at a high temperature of approximately 1500° C. It is noted that this combustion temperature is selected, depending on the fuel used. Thus, in the high-temperature reductive combustion zone 2, the convection of the combustion gas is generated, while creating a vortex in the horizontal direction, due to each flame generated from the burners 5 respectively arranged with the axes thereof horizontally shifted relative to one another. Further, because the density of the combustion gas should be considerably lowered under the so high temperature atmosphere in the high-temperature reductive combustion zone 2, the combustion gas can remain, for a relatively long time, in such a high-temperature reductive combustion zone 2. As such, the combustion gas can be kept at an adequately high temperature by the refractory material 6, resulting in well stabilized and uniform combustion of the fuel in the reductive combustion zone 2.

Then, such combustion gas, which has been well heated through the combustion in the high-temperature reductive combustion zone 2, is purged downward from the reductive combustion zone 2 into the second-step combustion zone 3 through the narrowed portion 4, due to increase of new combustion gas produced from the fuel further charged therein. In this second-step combustion zone 3, the second-step combustion air of a relatively low temperature is adequately supplied from the second-step combustion air nozzles 7, in order to completely combust the fuel remaining uncombusted in the combustion gas.

After the completion of the combustion, the combustion gas is first flowed further downward in the combustion chamber, and then flowed into the rear pass 12 via the gas outlet port 11. In this rear pass 12, the combustion gas is subjected to heat exchange with the water supplied to the boiler, while being flowed through the super-heater tube 13 and economizer 14, and then is flowed into the post-treatment step.

In the case in which the combustion ash generated from metal-containing materials and/or carbon, each remaining in a non-combusted or uncombusted state in the fuel, is the petroleum coke, the melting point of such ash is approximately 1200 to 1400° C. Therefore, under the temperature condition of 1500 to 1600° C. in the high-temperature reductive combustion zone 2, such ash is liquefied or melted, and then attached to and flowed downward along the furnace wall, or fall down, as droplets, in the combustion gas, or otherwise flowed downward together with the combustion gas. Further, in some cases, the melted combustion ash, once flowed downward along the wall of the high-temperature reductive combustion zone 2, fall down, in turn, as the droplets, from an edge of the narrowed portion 4, and then further flowed downward along the wall of the second-step combustion zone 3. In this case, since the temperature of the lower portion of the second-step combustion zone 3 is set at approximately 1100° C., the melted combustion ash is rapidly cooled lower than the melting point thereof, during the flow down along the wall of such a low-temperature second-step combustion zone 3, thus being solidified soon.

Meanwhile, the melted combustion ash flowed downward together with the combustion gas in the second-step combustion zone 3 is changed into fine particles and then fall down toward the furnace bottom portion of the combustion chamber 1. In addition, the melted combustion ash attached to the wall of the combustion chamber 1 and then solidified due to the relatively low temperature of the second-step combustion zone 3 is soon peeled off from the wall, then slip down along the wall surface, and finally fall down onto the bottom portion of the combustion chamber 1. In either case, because the lower portion of the combustion chamber 1 is steeply tapered, the solidified combustion ash falling down toward the furnace bottom portion is likely to be gathered at the bottom portion of the combustion chamber 1. This can significantly facilitate the discharge of such combustion ash accumulated on and around the bottom portion of the combustion chamber 1, from the ash discharge port 8 of the chamber 1. This ash discharge port 8 may be designed to be always opened, or otherwise may be provided with a lid-like bottom plate adapted for enabling the discharge port 8 to be optionally opened. With the provision of such a lid-like bottom plate, the ash can be discharged and collected, as needed, by opening the bottom plate. For enabling the combustion ash to be discharged, in an adequately solidified state, from the ash discharge port 8 located at the furnace bottom portion, the temperature of the combustion gas around the gas outlet port 11 is preferably lowered up to a certain temperature, suitable for the combustion conditions of the fuel used as well as suitable for the state of the accumulated ash.

Alternatively, for continuously discharging the ash, a proper water-sealing chain conveyor may be used.

Thereafter, the gas is flowed through the rear pass 12 including the super-heater tube 13 and economizer 14, and then the flow speed of the combustion gas containing the remaining ash is lowered. As a result, such remaining ash is separated from the combustion gas and then fall down toward the additional ash discharge port 15 provided to the rear pass 12. As such, the ash can also be discharged and collected from the discharge port 15.

Namely, in the upside-down type low NOx boiler of this embodiment, the carbon fuel is combusted, in a two-step combustion manner, wherein the carbon fuel is initially combusted under the high-temperature reductive atmosphere in the high-temperature reductive combustion zone 2, and then further combusted under the low-temperature oxidative atmosphere in the second-step combustion zone 3.

Figure 3:
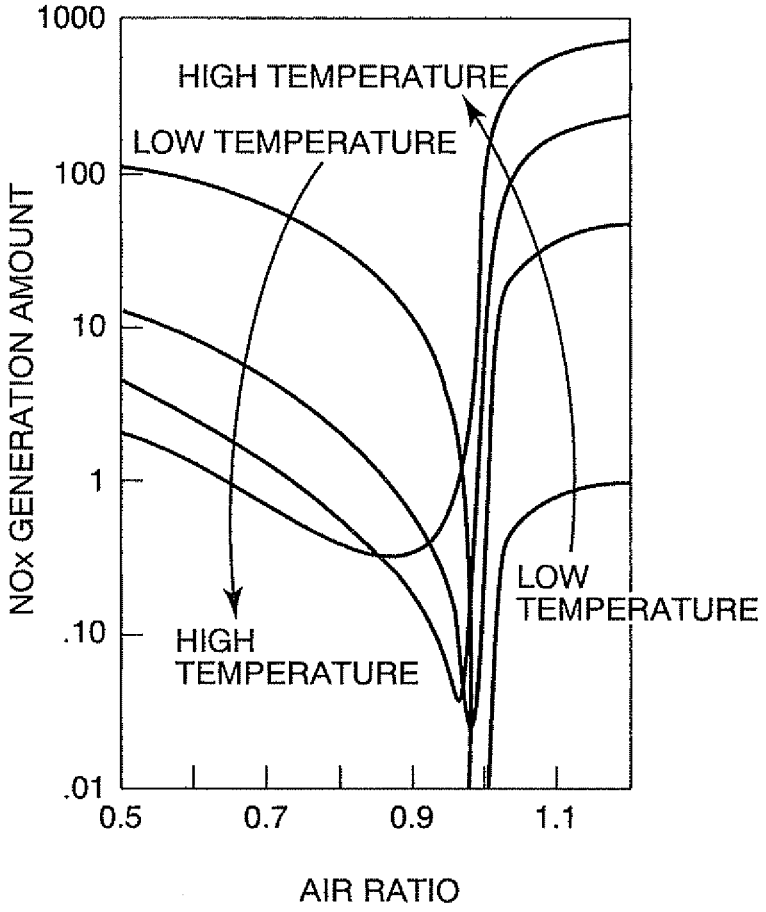
FIG. 3 is a graph showing the NOx generation amount relative to the air ratio and/or combustion temperature in the combustion region.

As shown in FIG. 3, the NOx generation amount during the combustion of the carbon fuel highly depends on the combustion temperature and air ratio. Namely, under the condition of the air ratio less than 1, i.e., under the reductive atmosphere, the NOx generation amount is decreased as the temperature is elevated. Meanwhile, under the condition of the air ratio greater than or equal to 1, i.e., under the oxidative atmosphere, the NOx generation amount is lessened as the temperature is lowered.

Thus, according to the boiler of this embodiment, by utilizing such properties, i.e., by combusting the carbon fuel in the two-step combustion manner comprising the first high-temperature reductive combustion step and second low-temperature oxidative combustion step, the NOx generation amount can be effectively reduced.

Generally, because of a considerably high temperature in a usual combustion furnace, nitrogen contained in the fuel is first changed into nitrogen-containing intermediate products rapidly, such as nitrogen cyanide, ammonia, nitrogen oxide and the like, and then a part of such intermediate products is further oxidized into the nitrogen oxide.

Meanwhile, in the combustion chamber of this embodiment, the production of such NOx can be effectively controlled or suppressed. This is because the NOx production can be positively suppressed, due to the reduction of the nitrogen-containing intermediate products into nitrogen, under the high-temperature reductive atmosphere in the high-temperature reductive combustion zone 2, as well as the thermal NOx generation can be successfully controlled, due to the complete combustion of the uncombusted fuel, with the additional charge of the second-step combustion air, at a substantially lowered gas temperature, in the second-step combustion zone 3.

Figure 4:
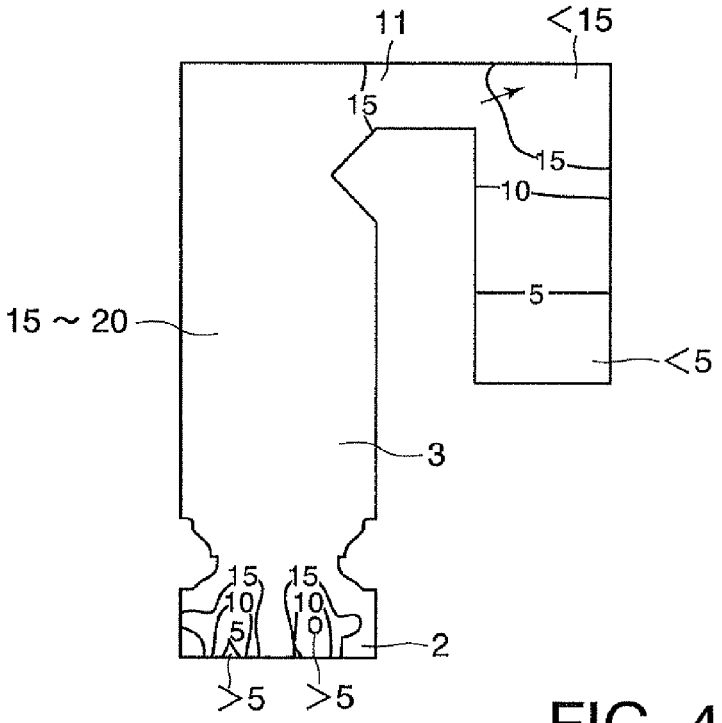
FIG. 4 is a diagram for illustrating pressure distribution in one conventional two-step combustion boiler.
Figure 5:
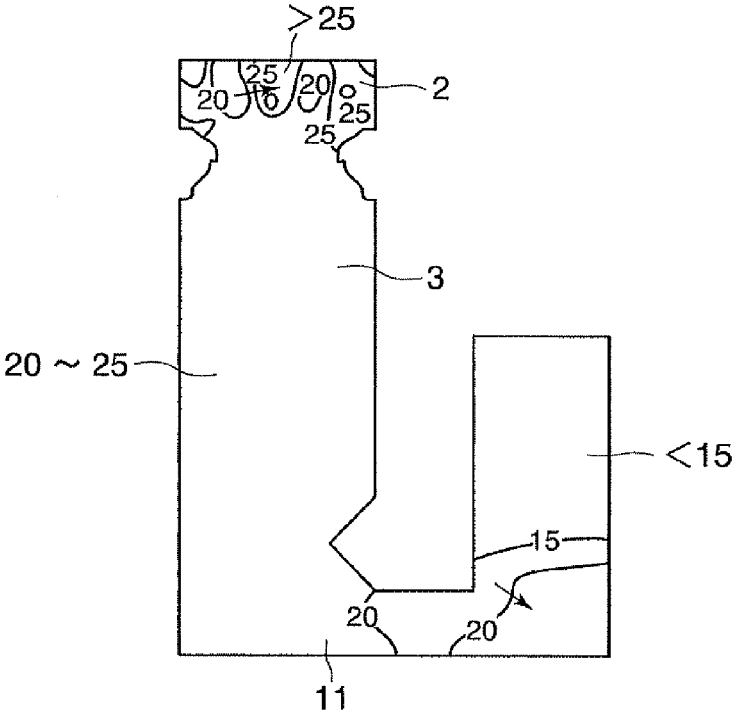
FIG. 5 is a diagram for illustrating the pressure distribution in the upside-down type low NOx boiler of this embodiment.
Figure 6:
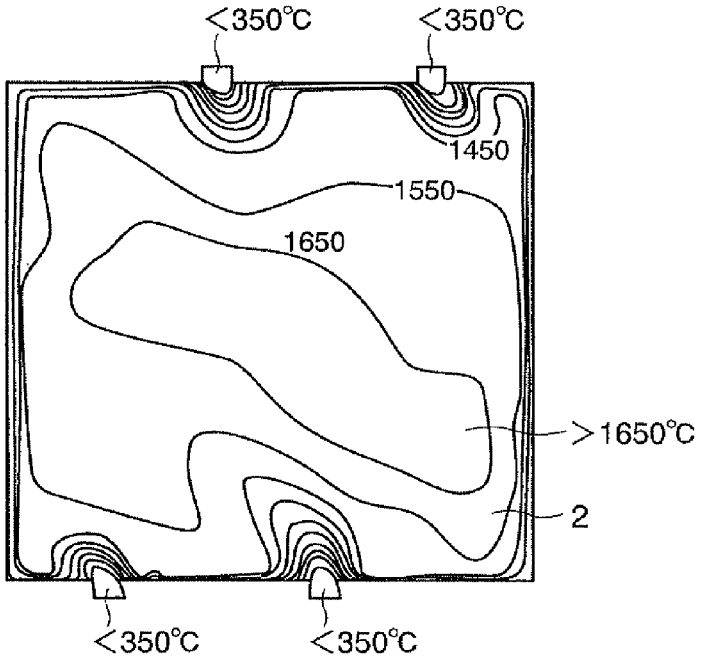
FIG. 6 is a diagram for illustrating temperature distribution in a transverse cross section of the high-temperature reductive combustion zone related to the conventional two-step combustion boiler.
Figure 7:
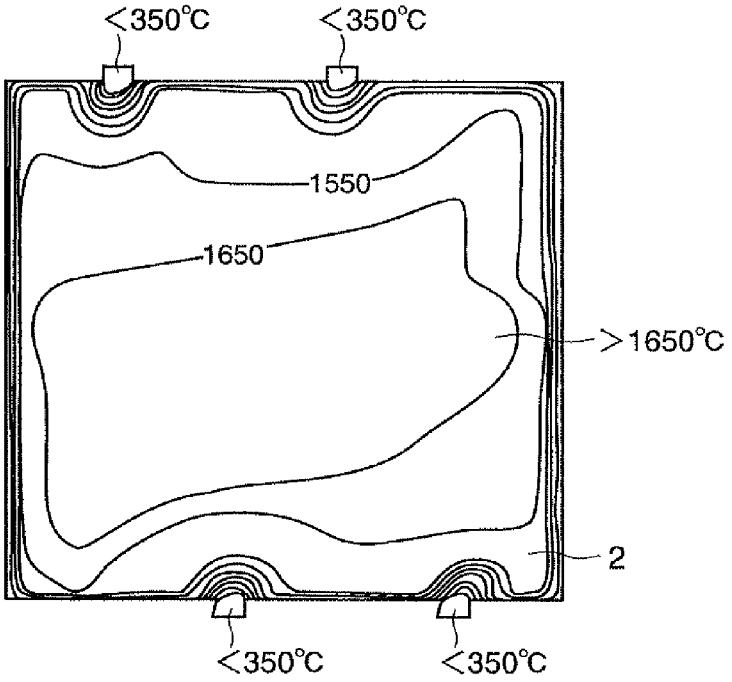
FIG. 7 is a diagram for illustrating the temperature distribution in the transverse cross section of the high-temperature reductive combustion zone related to the upside-down type low NOx boiler of this embodiment.
Figure 8:
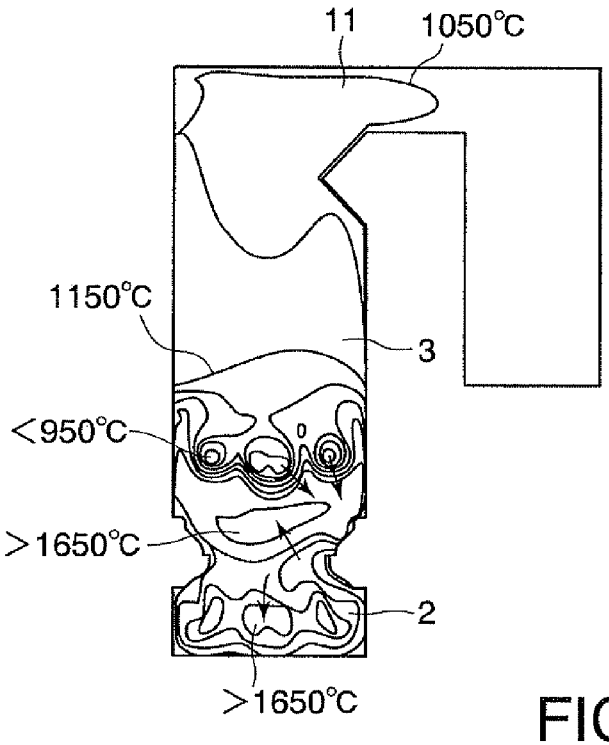
FIG. 8 is a diagram for illustrating the temperature distribution in a longitudinal cross section of the conventional two-step combustion boiler.
Figure 9:
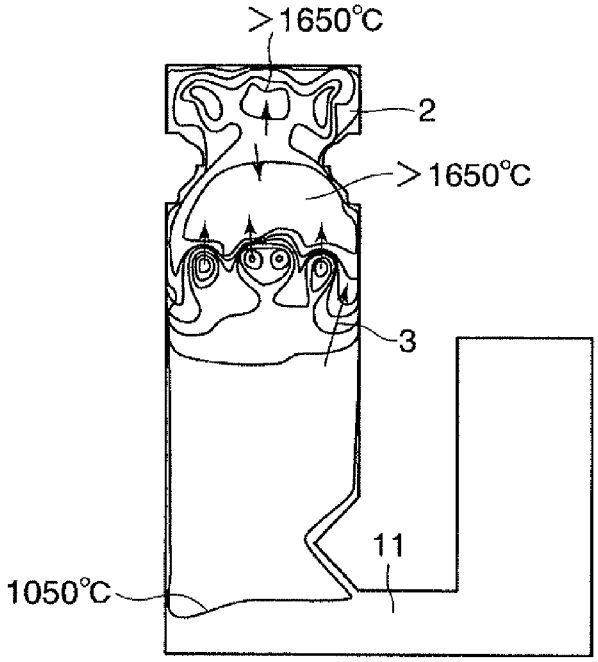
FIG. 9 is a diagram for illustrating the temperature distribution in the longitudinal cross section of the upside-down type low NOx boiler of this embodiment.
Figure 10:
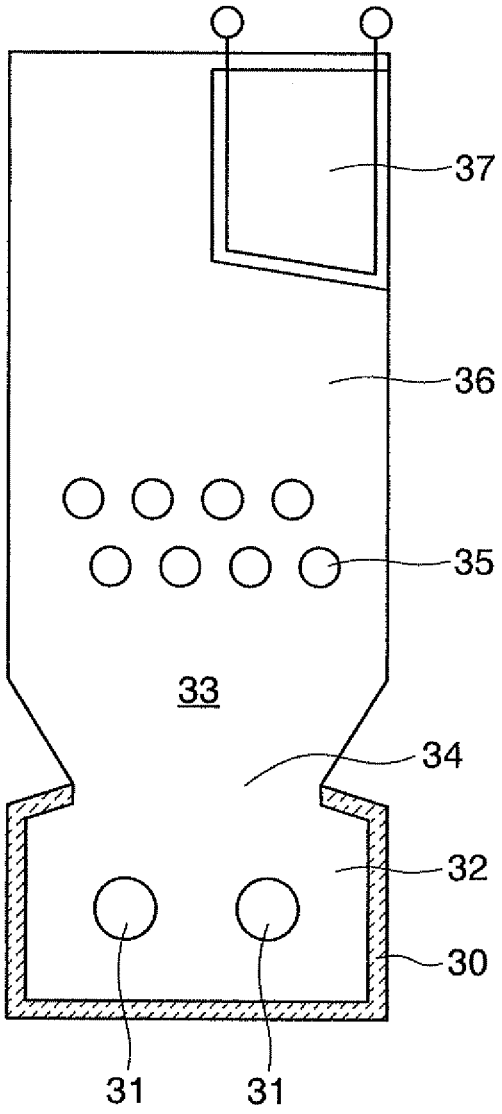
FIG. 10 is a schematic cross section of one conventional boiler.

In FIGS. 4 to 9, either of the pressure distribution or temperature distribution in each two-step combustion boiler is shown, by simulation, in regard to the upside-down type low NOx boiler related to this embodiment or conventional low NOx boiler. FIGS. 4 and 5 illustrate, respectively, the pressure distribution, in each longitudinal cross section of the conventional boiler and upside-down type low NOx boiler related to this embodiment. FIGS. 6 and 7 illustrate, respectively, the temperature distribution, in each transverse cross section of the respective high-temperature reductive combustion zones. FIGS. 8 and 9 illustrate, respectively, the temperature distribution, in each longitudinal cross section of the respective boilers.

As apparently seen from the comparison of the pressure distributions in the respective boilers shown in FIGS. 4 and 5, the pressure in the high-temperature reductive combustion zone 2 of the upside-down type low NOx boiler of this embodiment shown in FIG. 5 is relatively high. This is because the positioning of the high-temperature reductive combustion zone 2 above the low-temperature second-step combustion zone 3 can adequately suppress the flow down of the combustion gas from the high-temperature reductive combustion zone 2 toward the second-step combustion zone 3. Further, the gas pressure in the whole combustion chamber 1 is higher than that in the conventional boiler. In particular, the gas density in the combustion chamber 1 around the high-temperature reductive combustion zone 2 is conspicuously high. In addition, because of the buoyancy that can be created and exerted in the direction reverse to the downward flow direction of the combustion gas, undue flow down of the combustion gas in the vicinity of or along the furnace wall can be positively controlled. As such, well uniformed combustion can be performed, in each of the high-temperature combustion zone 2 and second-step combustion zone 3.

Further, from the comparison of the temperature distributions in the transverse cross sections of the respective high-temperature combustions zones shown in FIGS. 6 and 7, the combustion gas having a higher temperature is spread more widely in the high-temperature reductive combustion zone 2 of the upside-down type low NOx boiler of this embodiment shown in FIG. 7. From this phenomenon, it can be seen that the combustion in the high-temperature reductive combustion zone 2 of this embodiment can be performed, more uniformly and stably, as compared with the combustion performed in the conventional boiler.

Further, from the comparison of the temperature distributions in the longitudinal cross sections of the respective combustion chambers shown in FIGS. 8 and 9, it can be seen that a relatively high temperature region can be created more widely in the high-temperature reductive combustion zone 2, and that the temperature around the gas outlet port 11 in the vicinity of the furnace bottom portion can be set substantially lower, in the upside-down type low NOx boiler of this embodiment shown in FIG. 9. It can also be seen that the temperature can be further uniformed, in this embodiment, over the whole region in the furnace, as compared with the conventional combustion chamber. Thus, it can be duly expected that the NOx generation amount can be substantially reduced, by the two-step combustion related to this invention, i.e., the first high-temperature combustion step performed under the reductive atmosphere in the high-temperature reductive combustion zone 2 and the second low-temperature combustion step performed under the oxidative atmosphere in the second-step combustion zone 3.

Further, from the velocity vector of the combustion gas in the furnace, as is similar to the case of the conventional low NOx boiler, a backflow tendency of the combustion gas from the level of the narrowed portion in the reductive combustion chamber toward the respective burners can be observed in the upside-down type low NOx boiler of this embodiment. However, in this embodiment, the backflow of the combustion gas from a further downstream point relative to the narrowed portion was not observed.

As illustrated in the drawings, the temperature in the high-temperature reductive combustion zone 2 in the upside-down type low NOx boiler of this embodiment is set higher than the temperature set in the conventional boiler. Accordingly, for enhancing cooling ability, the steam drum 9 is provided in the position higher than the top end of the combustion chamber 1. In this way, the non-heated downcomer pipe 10 can be provided to extend longer than the height of the combustion chamber 1, thus positively increasing the pressure of the boiler water flowed through such an elongated non-heated downcomer pipe 10, thereby enhancing a circulation effect of the boiler water.

Meanwhile, in the conventional low NOx boiler, the high-temperature reductive combustion zone has been positioned at the furnace bottom portion on and around which the ash is accumulated. Therefore, if the ash discharge port is provided to the furnace bottom portion, the air entering the furnace bottom portion via such an ash discharge port would rather disturb the reductive atmosphere of the high-temperature reductive combustion zone. Further, since the combustion gas filled in the high-temperature reductive combustion zone is still in an incompletely combusted state and thus containing harmful carbon monoxide, sulfide or the like, there may be a risk that an operator or user of this boiler would experience, inadvertently or accidentally, serious damage or injury. In addition, it has been quite difficult, from the technological viewpoint, to discharge, stably and safely, the melted ash accumulated in the furnace bottom portion of the high-temperature reductive combustion zone. Accordingly, it has been so far considered to be impossible or rather unreasonable to provide the ash discharge port to the furnace bottom portion. Thus, in the conventional art, there has been a need for stopping the boiler, once for several months or half year, in order to collect the accumulated ash. Especially, in the case of using the low-quality fuel containing a greater amount of ash-forming materials, the furnace should be cleaned, so frequently, leading to an unduly bad management. Therefore, such low-quality fuel has not been so far used in this field.

However, the upside-down type low NOx boiler of this embodiment has such a structure that the conventional low NOx boiler is directly inverted. That is, the high-temperature reductive combustion zone 2 is positioned in the upper portion of the boiler, while the low-temperature second-step combustion zone 3 is located below the high high-temperature reductive combustion zone 2. Namely, this configuration can achieve the provision of the ash discharge port 8 to the furnace bottom portion on which the ash falls down and is accumulated.

Namely, in the boiler of this embodiment, the combustion gas flowed around the ash discharge port 8 has been completely combusted through the second-step combustion zone 3. Therefore, the amount of the harmful materials, such as the carbon monoxide, sulfide and the like, that would be otherwise considerably produced by the uncompleted combustion can be effectively reduced. As such, the toxicity of the combustion gas due to such harmful materials can be significantly lowered. Further, since the ash discharge port 8 is positioned substantially outside the combustion zone, the bad influence on the combustion that may be otherwise seriously caused by accidental cooling due to the outside air entering the combustion zone via the port as well as undue deterioration of the de-nitration effect due to rather unbalanced air ratio can be successfully reduced.

Furthermore, with the provision of the ash discharge port 8 to the boiler of this embodiment, the ash can be discharged and collected, from the outside, without any stop of the furnace. Namely, the furnace can be continuously operated. Moreover, this configuration of the combustion boiler can enable the use of the low-quality fuel containing a considerably large amount of ash-forming materials. Therefore, by using the boiler of this embodiment, the cost required for the operation can be significantly saved. Additionally, since most of the ash can be collected by using the ash discharge port 8, the load that may be otherwise imposed on a dust collector or the like provided in the further post-treatment step can be substantially reduced.

Thus, the combustion boiler of the above embodiment can be operated, even with the use of the low-quality fuel, such as the bunker-C, asphalt, petroleum coke, carbonized sewage sludge or the like, that contains a large amount of nitrogen-containing materials and ash-forming materials and thus has been so far quite difficult to use. Therefore, the cost required for the fuel can be greatly saved, thereby achieving highly economical management. Further, the combustion boiler of this embodiment can also utilize, positively, the low-quality fossil fuel that has not been so far usually used and/or carbonized sewage sludge that is non-fossil fuel. Therefore, the upside-down type low NOx boiler of this embodiment is highly effective for slowing down the current tendency of the drying up of the fossil fuel.

As stated above, while the present invention has been shown and described in regard to one preferred embodiment thereof. However, the technical scope of this invention is not limited to the description provided for the above embodiment. Namely, various modifications and alterations can be made to this embodiment. It should be understood that such modifications and alterations are intended to be included in the scope of this invention, and it should be construed that the scope of this invention is defined by only the appended claims.

INDUSTRIAL APPLICABILITY

This invention can be generally applied to the boiler configured for obtaining the thermal energy by combusting the carbon fuel.

The invention claimed is:

1. An upside-down type low NOx boiler comprising:
a vertical combustion chamber;
the vertical combustion chamber including:
a high-temperature reductive combustion zone provided to an upper portion of the combustion chamber and surrounded by a refractory material and having a burner;
a low-temperature oxidative combustion zone provided below the high-temperature reductive combustion zone and surrounded by a water wall and having a second-step combustion air nozzle;
a combustion gas outlet port provided below the low-temperature oxidative combustion zone; and
an ash discharge mechanism provided to a bottom portion of the combustion chamber and connected with a steam drum and a non-heated downcomer pipe for cooling the low-temperature oxidative combustion zone,
wherein the burner combusts a low-quality fuel under a high-temperature reductive atmosphere in the high-temperature reductive combustion zone, so as to produce a combustion gas, and
wherein the second-step combustion air nozzle supplies a second-step combustion air having a temperature lower than a temperature of the combustion gas, so as to further combust a partly combusted gas flowed downward from the high-temperature reductive combustion zone, under a low-temperature oxidative atmosphere,
wherein the combustion gas is flowed out from the combustion gas outlet port, and an ash that is accumulated on a furnace bottom portion of the combustion chamber is discharged, during the operation of the furnace, by using the ash discharge mechanism, and
wherein a narrowed portion for reducing the horizontal cross section of the combustion chamber by 20%-50% is provided between the high-temperature reductive combustion zone and the low-temperature oxidative combustion zone.

2. The upside-down type low NOx boiler according to claim 1, wherein the furnace bottom portion of the combustion chamber is tapered, and the ash discharge mechanism is provided to a lower end of the furnace bottom portion.

3. The upside-down type low NOx boiler according to claim 2, wherein the angle of the furnace bottom portion is less than or equal to 45° relative to a vertical line.

4. The upside-down type low NOx boiler according to claim 1, wherein the burners are arranged along two opposite side faces of the high-temperature reductive combustion zone, respectively, horizontally in parallel with one another, with the flame axes of the burners respectively oriented not to cross one another, and the combustion gas creates a vortex flow.

5. An upside-down type low NOx boiler comprising:
a vertical combustion chamber;
the vertical combustion chamber including:
a high-temperature reductive combustion zone provided to an upper portion of the combustion chamber and surrounded by a refractory material and having a burner;
a low-temperature oxidative combustion zone provided below the high-temperature reductive combustion zone and surrounded by a water wall and having a second-step combustion air nozzle;
a combustion gas outlet port provided below the low-temperature oxidative combustion zone and communicated with a rear pass; and
an ash discharge mechanism provided to a bottom portion of the combustion chamber and connected with a steam drum and a non-heated downcomer pipe for cooling the low-temperature oxidative combustion zone,
wherein the burner combusts a low-quality fuel under a high-temperature reductive atmosphere in the high-temperature reductive combustion zone, so as to produce a combustion gas, and
wherein the second-step combustion air nozzle supplies a second-step combustion air having a temperature lower than a temperature of the combustion gas, so as to further combust a partly combusted gas flowed downward from the high-temperature reductive combustion zone, under a low-temperature oxidative atmosphere,
wherein the combustion gas flowed downward from the low-temperature oxidative combustion zone is flowed out from the combustion gas outlet port, and the combustion gas flowed out from the combustion gas outlet port is flowed upward in the rear pass and then passes through a super-heater tube, and
wherein an ash that is accumulated on a furnace bottom portion of the combustion chamber is discharged, during the operation of the furnace, by using the ash discharge mechanism.

6. The upside-down type low NOx boiler according to claim 5, wherein a narrowed portion for reducing the horizontal cross section of the combustion chamber by 20%-50% is provided between the high-temperature reductive combustion zone and the low-temperature oxidative combustion zone.

7. The upside-down type low NOx boiler according to claim 5, wherein the furnace bottom portion of the combustion chamber is tapered, and the ash discharge mechanism is provided to a lower end of the furnace bottom portion.

8. The upside-down type low NOx boiler according to claim 7, wherein the angle of the furnace bottom portion is less than or equal to 45° relative to a vertical line.

9. The upside-down type low NOx boiler according to claim 5, wherein the burners are arranged along two opposite side faces of the high-temperature reductive combustion zone, respectively, horizontally in parallel with one another, with the flame axes of the burners respectively oriented not to cross one another, and the combustion gas creates a vortex flow.

10. The upside-down type low NOx boiler according to claim 6, wherein the furnace bottom portion of the combustion chamber is tapered, and the ash discharge mechanism is provided to a lower end of the furnace bottom portion.

11. The upside-down type low NOx boiler according to claim 10, wherein the angle of the furnace bottom portion is less than or equal to 45° relative to a vertical line.

* * * * *